US006041451A

United States Patent [19]

Francis

[11] Patent Number: 6,041,451

[45] Date of Patent: Mar. 28, 2000

[54] SPLASH SHIELD FOR A TOILET

[76] Inventor: Robert A. Francis, 55 Pacifica Ave. Space 48, Bay Point, Calif. 94565

[21] Appl. No.: 09/252,118

[22] Filed: Feb. 18, 1999

Related U.S. Application Data

[60] Provisional application No. 60/075,785, Feb. 23, 1998, provisional application No. 60/077,604, Mar. 10, 1998, and provisional application No. 60/083,373, Apr. 28, 1998.

[51] Int. Cl.[7] ..... E03D 9/00

[52] U.S. Cl. ..... 4/300.3; 4/300; 4/DIG. 5

[58] Field of Search ..... 4/300.3, 300, 420.2, 4/DIG. 5

[56] References Cited

U.S. PATENT DOCUMENTS 3,931,649 1/1976 Jankowski ..... 4/300.3
4,063,316 12/1977 Hunninghaus ..... 4/300
4,709,426 12/1987 Godwin, Jr. ..... 4/300.3
5,031,259 7/1991 Baiera et al. ..... 4/300.3

*Primary Examiner*—Henry J. Recla
*Assistant Examiner*—Khoa Huynh

[57] ABSTRACT

A splash shield for a toilet for preventing urine and waste from splashing out of a toilet bowl. The splash shield for a toilet includes an annular main portion designed for mounting below a rim of a toilet bowl. The main portion has upper and lower sides and front and back ends. The main portion has a bore extending through it. The bore is in communication with a source of pressurized air. The main portion has a plurality of vent holes extending into the bore from an inner perimeter of the main portion.

10 Claims, 10 Drawing Sheets

26
10
16
12
23
24
18
17
19
23
15

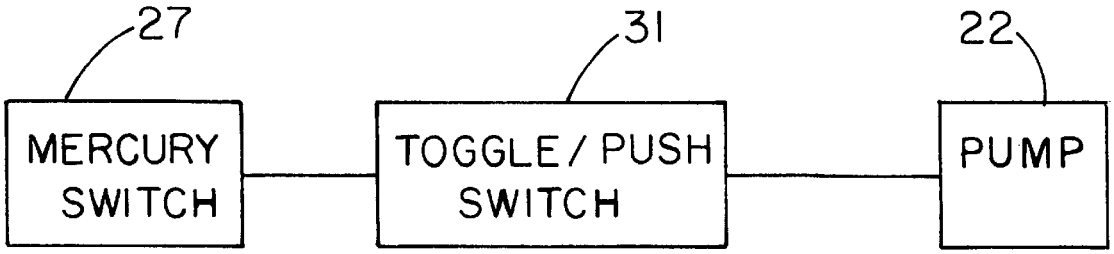
FIG. 4
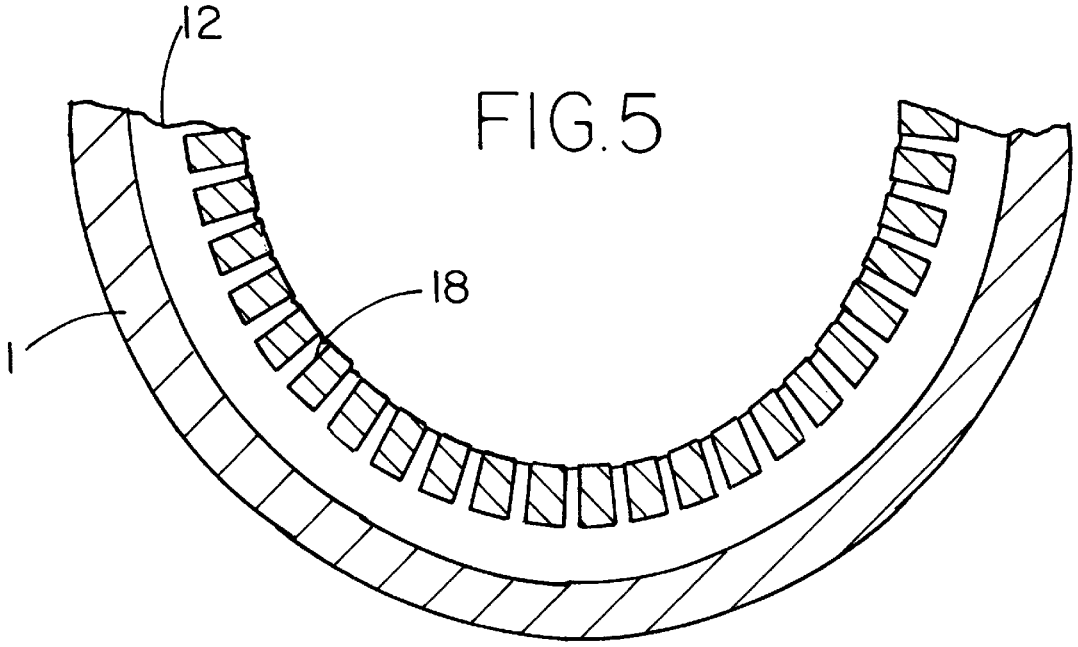
FIG. 5
FIG. 6
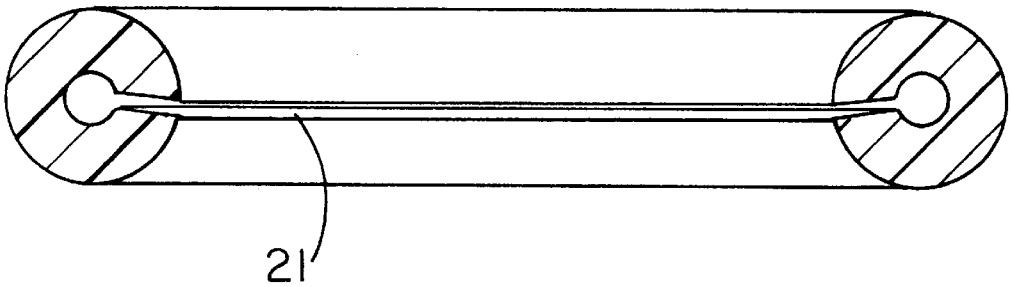

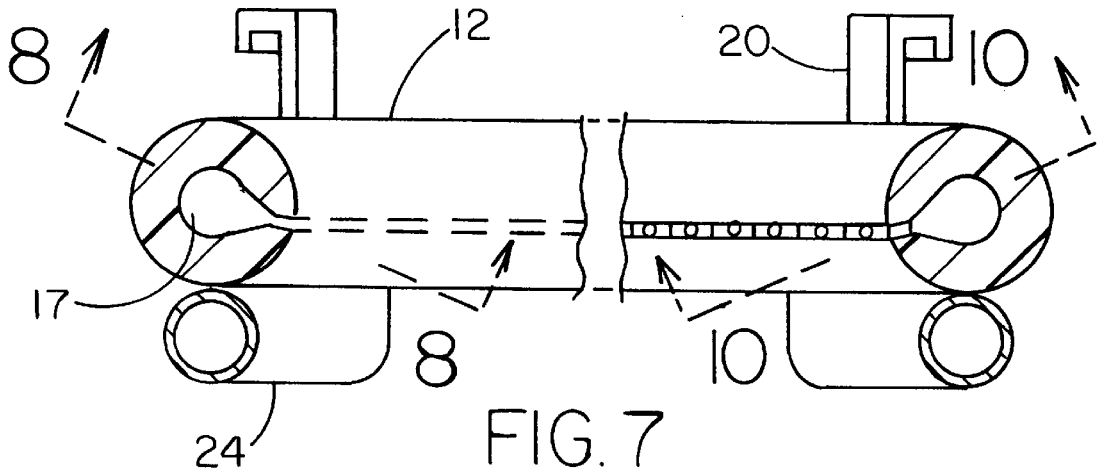
FIG. 7
FIG. 8
FIG. 10
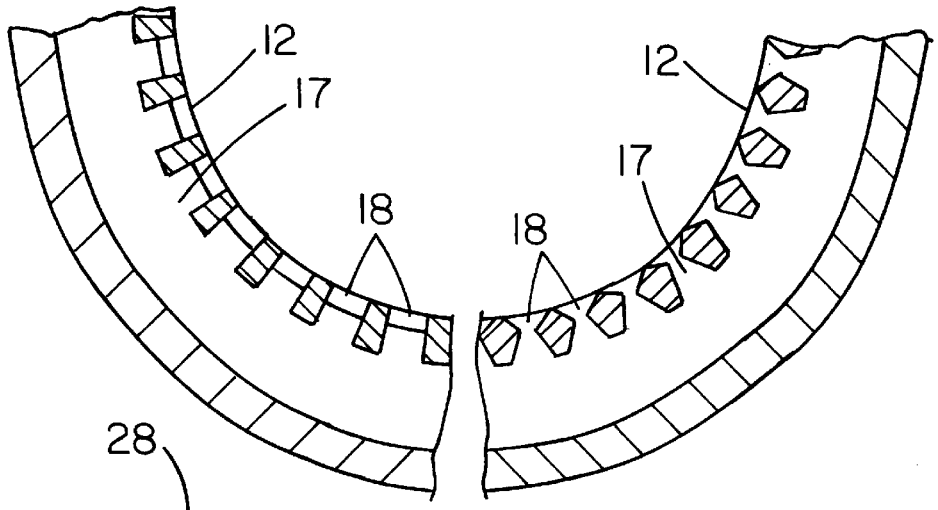
FIG. 9
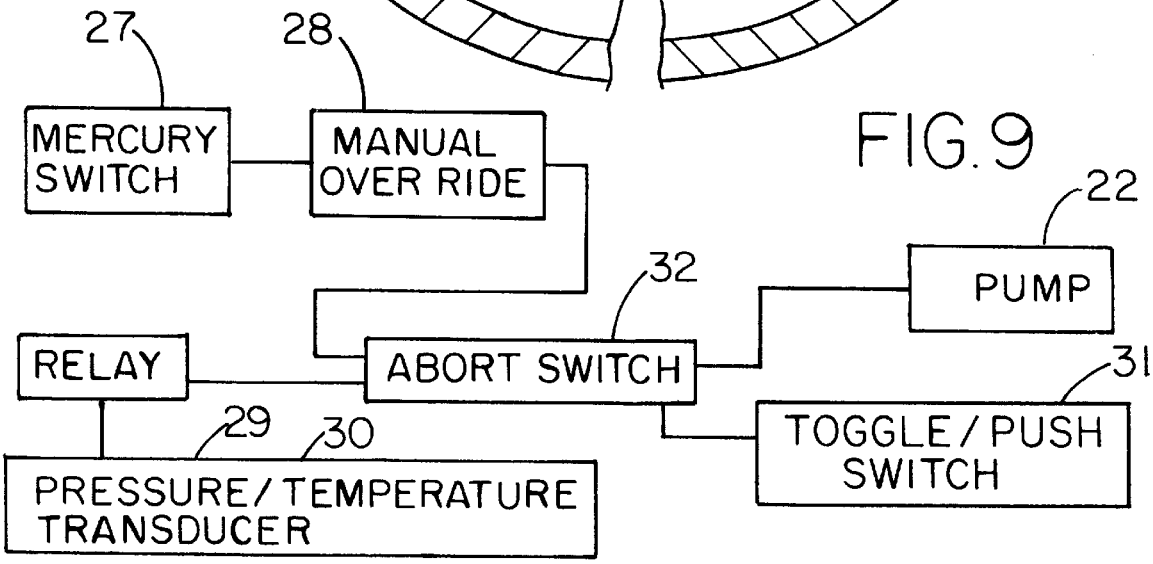

SPLASH SHIELD FOR A TOILET

RELATED APPLICATIONS

This application is related to our prior provisional patent applications: Ser. No. 60/075,785, filed Feb. 23, 1998; Ser. No. 60/077,604, filed Mar. 10, 1998; and Ser. No. 60/083,373, filed May 28, 1998.

BACKGROUND OF THE INVENTION

1. Field of the Invention

The present invention relates to splash guards and more particularly pertains to a new splash shield for a toilet for preventing urine and waste from splashing out of a toilet bowl.

2. Description of the Prior Art

The use of splash guards is known in the prior art. More specifically, splash guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,241,712; U.S. Pat. No. 2,172,506; U.S. Pat. No. 4,123,967; U.S. Pat. No. 3,332,334; U.S. Pat. No. 3,931,649; and U.S. Pat. No. Des. 353,659.

While these devices fulfill their respective, particular objectives and requirements, the aforementioned patents do not disclose a new splash shield for a toilet. The inventive device includes an annular main portion designed for mounting below a rim of a toilet bowl. The main portion has upper and lower sides and front and back ends. The main portion has a bore extending through it. The bore is in communication with a source of pressurized air. The main portion has a plurality of vent holes extending into the bore from an inner perimeter of the main portion.

In these respects, the splash shield for a toilet according to the present invention substantially departs from the conventional concepts and designs of the prior art, and in so doing provides an apparatus primarily developed for the purpose of preventing urine and waste from splashing out of a toilet bowl.

SUMMARY OF THE INVENTION

In view of the foregoing disadvantages inherent in the known types of splash guards now present in the prior art, the present invention provides a new splash shield for a toilet construction wherein the same can be utilized for preventing urine and waste from splashing out of a toilet bowl.

The general purpose of the present invention, which will be described subsequently in greater detail, is to provide a new splash shield for a toilet apparatus and method which has many of the advantages of the splash guards mentioned heretofore and many novel features that result in a new splash shield for a toilet which is not anticipated, rendered obvious, suggested, or even implied by any of the prior art splash guards, either alone or in any combination thereof.

To attain this, the present invention generally comprises an annular main portion designed for mounting below a rim of a toilet bowl. The main portion has upper and lower sides and front and back ends. The main portion has a bore extending through it. The bore is in communication with a source of pressurized air. The main portion has a plurality of vent holes extending into the bore from an inner perimeter of the main portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new splash shield for a toilet apparatus and method which has many of the advantages of the splash guards mentioned heretofore and many novel features that result in a new splash shield for a toilet which is not anticipated, rendered obvious, suggested, or even implied by any of the prior art splash guards, either alone or in any combination thereof.

It is another object of the present invention to provide a new splash shield for a toilet which may be easily and efficiently manufactured and marketed.

It is a further object of the present invention to provide a new splash shield for a toilet which is of a durable and reliable construction.

An even further object of the present invention is to provide a new splash shield for a toilet which is susceptible of a low cost of manufacture with regard to both materials and labor, and which accordingly is then susceptible of low prices of sale to the consuming public, thereby making such splash shield for a toilet economically available to the buying public.

Still yet another object of the present invention is to provide a new splash shield for a toilet which provides in the apparatuses and methods of the prior art some of the advantages thereof, while simultaneously overcoming some of the disadvantages normally associated therewith.

Still another object of the present invention is to provide a new splash shield for a toilet for preventing urine and waste from splashing out of a toilet bowl.

Yet another object of the present invention is to provide a new splash shield for a toilet which includes an annular main portion designed for mounting below a rim of a toilet bowl. The main portion has upper and lower sides and front and back ends. The main portion has a bore extending through it. The bore is in communication with a source of pressurized air. The main portion has a plurality of vent holes extending into the bore from an inner perimeter of the main portion.

Still yet another object of the present invention is to provide a new splash shield for a toilet that manipulates air flow to keep splashes and waste in the toilet bowl. In particular, air is ejected through closely spaced vent holes, creating a blanket effect that permits a stream of liquid to pass down through the "air blanket", but would prevent splashes from coming up through the air blanket.

Even still another object of the present invention is to provide a new splash shield for a toilet that may turn on automatically when the toilet lid is lifted, or may have a switch that is activated by body heat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a diagram illustrating a switch system for controlling the air pump of the present invention.

FIG. 5 is a schematic cross sectional view of the present invention.

FIG. 6 is a schematic cross sectional view of an alternate embodiment of the present invention.

FIG. 7 is a schematic cross sectional view of the present invention illustrating two different configurations of vent holes.

FIG. 8 is a schematic cross sectional view of the present invention taken from line 8—8 of FIG. 7.

FIG. 9 is a diagram illustrating a switch system for controlling the air pump of the present invention.

FIG. 10 is a schematic cross sectional view of the present invention taken from line 10—10 of FIG. 7.

DESCRIPTION OF THE PREFERRED EMBODIMENT

Figure 1:
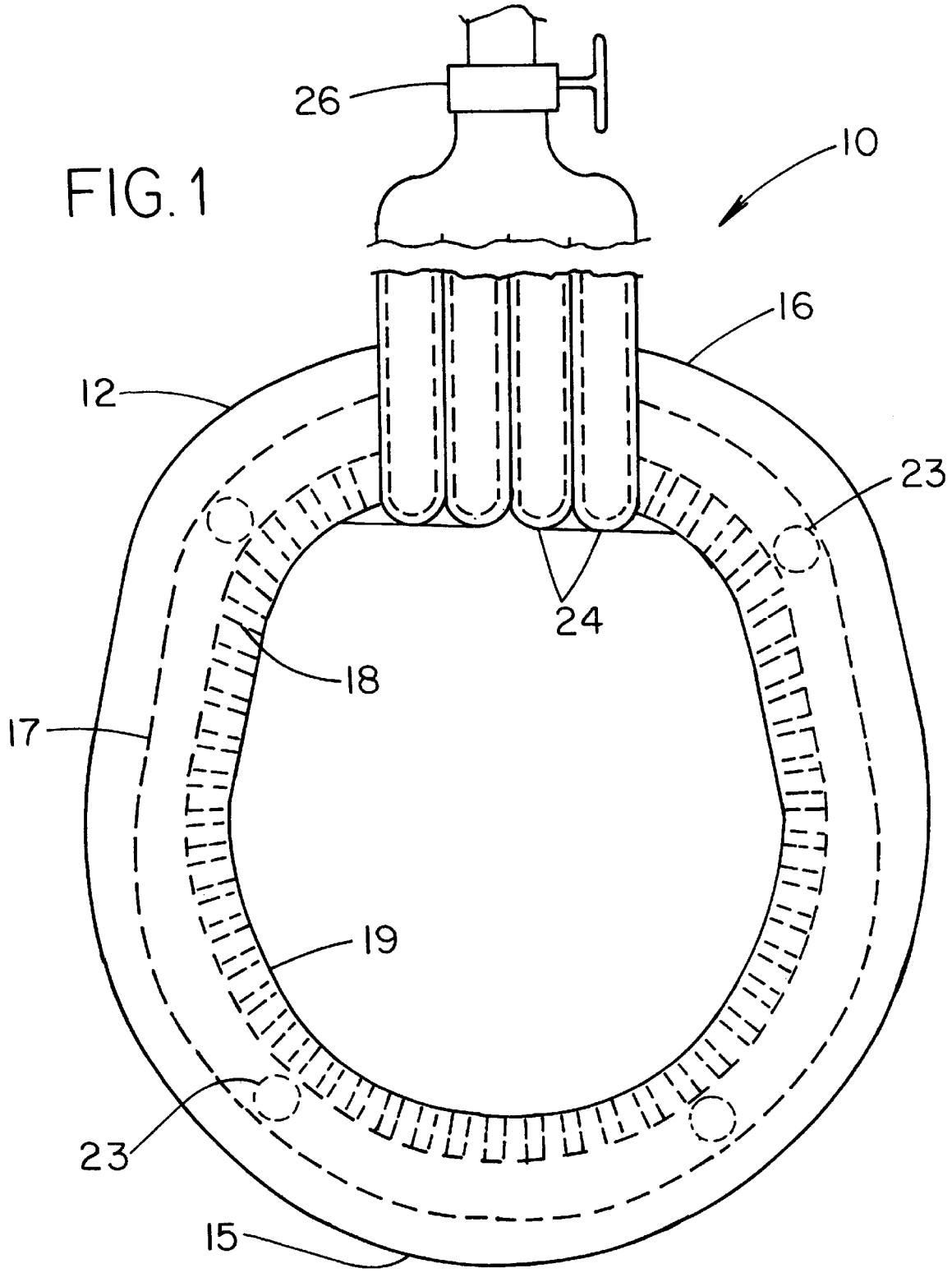
FIG. 1 is a schematic side view of a new splash shield for a toilet according to the present invention.

With reference now to the drawings, and in particular to FIGS. 1 through 18 thereof, a new splash shield for a toilet embodying the principles and concepts of the present invention and generally designated by the reference numeral 10 will be described.

As best illustrated in FIGS. 1 through 5, the splash shield for a toilet 10 generally comprises an annular main portion 12 designed for mounting below a rim 1 of a toilet bowl 2. The main portion has upper and lower sides 13,14 and front and back ends 15,16. The main portion has a bore 17 extending through it. The bore is in communication with a source of pressurized air. The main portion has a plurality of vent holes 18 extending into the bore from an inner perimeter 19 of the main portion.

Preferably, the inner periphery of the main portion is vertically flush with an inner periphery of the rim of the toilet bowl so that it does not lessen the area of the bowl opening into which a user may urinate.

Also preferably, a plurality of generally J-shaped support hooks 20, ideally four hooks each positioned 90 degrees from each other, extend from the main portion and are designed for hooking to the rim of the toilet bowl.

Preferably, the vent holes are angled downwardly at an angle of at least one degree from a horizontal plane. The most effective range is between at least 1 degree and about 30 degrees downward from the horizontal. The angling needs to be at least 1 degree so that when air streams form opposing vent holes come in contact with each other, the air will not rebound upward. The holes should not be angled beyond 45 degrees or the jets of air will not be effective.

Figure 3:
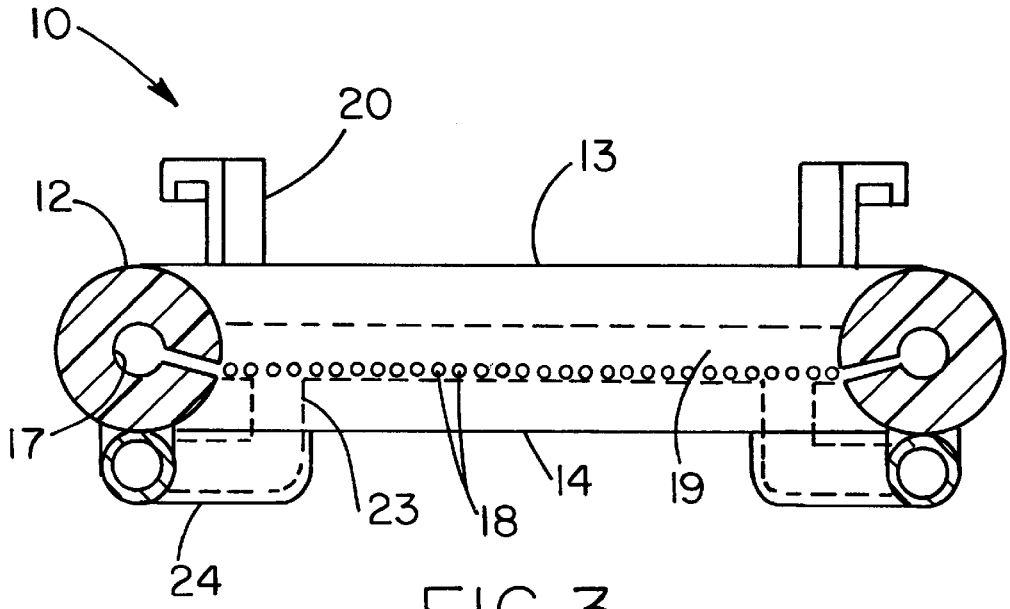
FIG. 3 is a schematic cross sectional view of the present invention taken from line 3—3 of FIG. 2.
Figure 2:
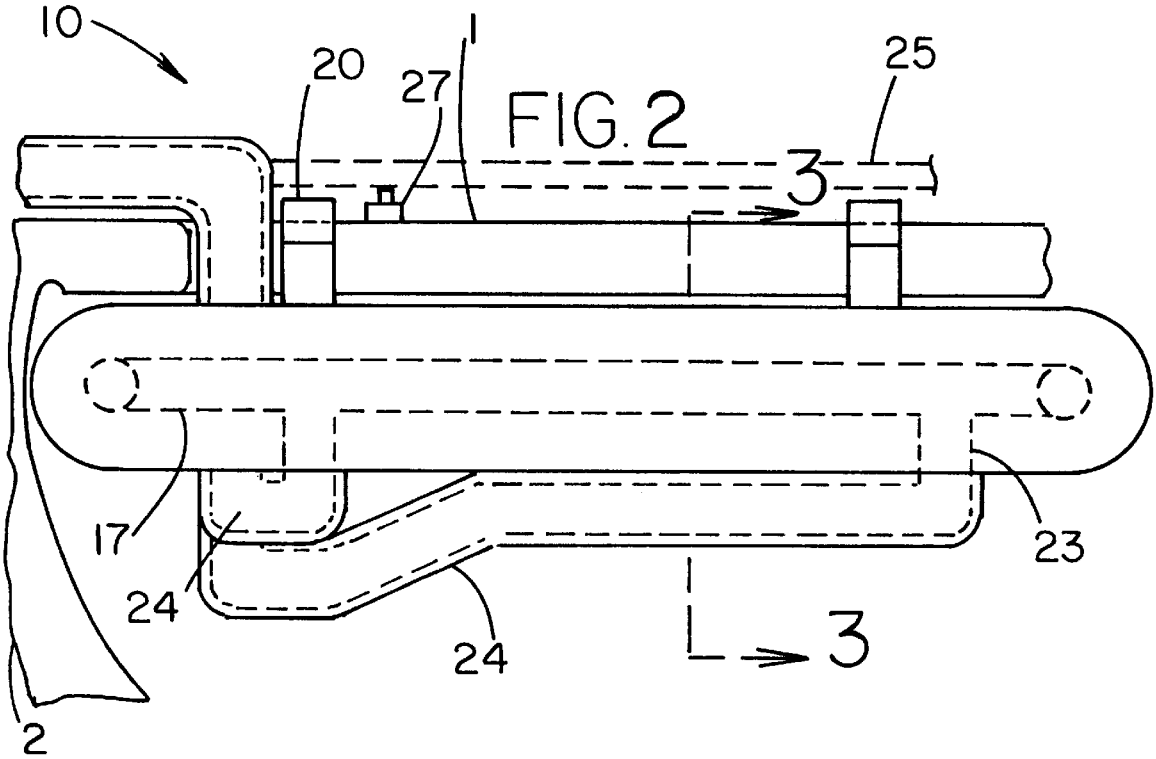
FIG. 2 is a schematic side view of the present invention.

The vent holes may be round or tubular, as shown in FIGS. 1, 3, and 5. Alternate vent holes include a rectangular configuration, shown in FIGS. 7 and 8, and conical vent holes, shown in FIGS. 7 and 10. The rectangular vent holes provide more of a blanket of air than the circular version. The jets of air ejected from the conical vent holes travel faster than the air exiting the round vent holes. In any of these embodiments, the bore could extend out and taper together towards the vent holes, as best seen in FIG. 7.

Where round vent holes are used, an inner diameter of each of the vent holes is preferably between 1 and 5 mm. Also preferably, the vent holes are spaced between 3 and 10 mm apart from outer edges thereof. This spacing is close enough that a "shield" effect is created, much like a blanket of air, through which splashes cannot travel.

Alternatively, as illustrated in FIG. 6, the main portion could have a vent slot 21 extending outwardly from the bore through an inner perimeter of the main portion. Again, the vent slot should angled downwardly at an angle of at least one degree from a horizontal plane, but not over 45 degrees.

Preferably, an air pump 22 provides the source of compressed air and is in communication with the bore of the main portion. The air pump should be capable of producing an output of 10 to 500 psi. Exemplary air pumps include rotary blowers as well as fans with radial blades.

Also preferably, the lower side of the main portion has four openings 23 into the bore. Ideally, the openings are positioned at 90 degree intervals about the main portion. Four air supply lines 24 are connected to the openings of the main portion and in fluid communication with the air pump. Ideally, the air supply lines extend along the lower side of the main portion so that they do not obstruct installation of the device nor be an obstruction that would splash urine out of the bowl if urinated upon.

Preferably, the air supply lines extend around an inner portion of the back end of the main portion and over the rim of the toilet bowl and between the hinges of the toilet seat 25 to the air pump. Ideally, the air supply lines taper together and open into a single tube, which has an air pressure adjustment valve 26 for adjusting the volume of air travelling to the main portion.

A seat switch 27 may be mounted to an upper surface of the rim of the toilet bowl and be in electrical communication with the air pump. The switch would activate the pump when the toilet seat is raised. The switch would deactivate the pump when the toilet seat is lowered.

An override switch 28 may disconnect the seat switch from the air pump. This would be useful in a household has children or child guests who would play with the toilet seat merely to activate the device. More importantly, it would allow the user to turn the air pump off when cleaning the toilet bowl.

Alternatively or in any combination with the above switches, a pressure transducer 29 is coupled to an upper surface of a toilet seat and in communication with the air pump. The pressure transducer activates the air pump when a user sits on the toilet seat.

Alternatively or in any combination with the above switches, a temperature transducer 30 is coupled to an upper surface of a toilet seat and in communication with the air pump. The temperature transducer senses the body heat of a user sitting on the toilet seat whereupon it activates the air pump.

Alternatively or in any combination with the above switches, an auxiliary switch 31 may be in communication with the air pump for selectively activating the air pump independent of the seat switch. This would be used when the seat is not raised and would ideally be located near the toilet flushing handle for convenience.

Alternatively or in any combination with the above switches, an abort switch 32 may be used to deactivate the air pump. As shown in FIG. 9, all of the switches would be connected to the abort switch. The abort switch allows a user to completely shut down the system, especially necessary when cleaning the toilet, where any of the number of switches could be accidentally activated.

In use, the main portion is installed in a toilet bowl with the vent holes aiming downward. The air pressure is set so that the shield of air created by the air escaping the vents is weak enough to allow the penetration of a stream of liquid (such as urine) but strong enough to prohibit any back or upward splash of liquids that would ordinarily splash onto the rim or completely out of the bowl. The switches control activation of the pump substantially as set forth above.

In an alternate embodiment, shown in FIGS. 11 through 18, the device is integrated into a toilet bowl. In such an embodiment, a rim 43 of the toilet bowl has upper and lower sides and front and back ends. The rim has a bore 41 extending through it. The bore is in communication with a source of pressurized air.

The rim has a plurality of vent holes 42 extending into the bore from an inner perimeter of the rim. The vent holes are angled downwardly at an angle of at least one degree from a horizontal plane. The most effective range is between at least 1 degree and about 30 degrees downward from the horizontal. The angling needs to be at least 1 degree so that when air streams form opposing vent holes come in contact with each other, the air will not rebound upward. The holes should not be angled beyond 45 degrees or the jets of air will not be effective.

Figure 11:
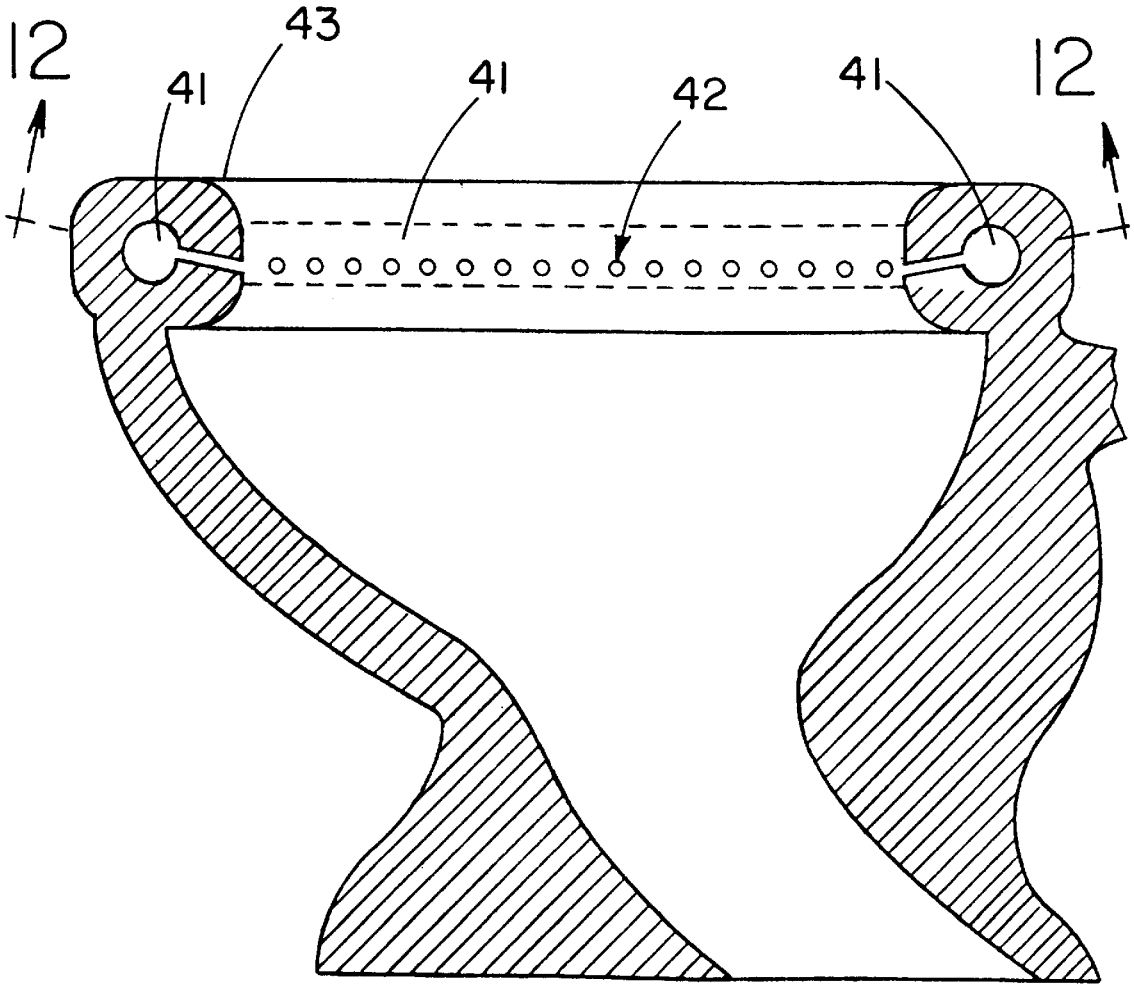
FIG. 11 is a schematic cross sectional view of an integrated version according to the present invention.
Figure 12:
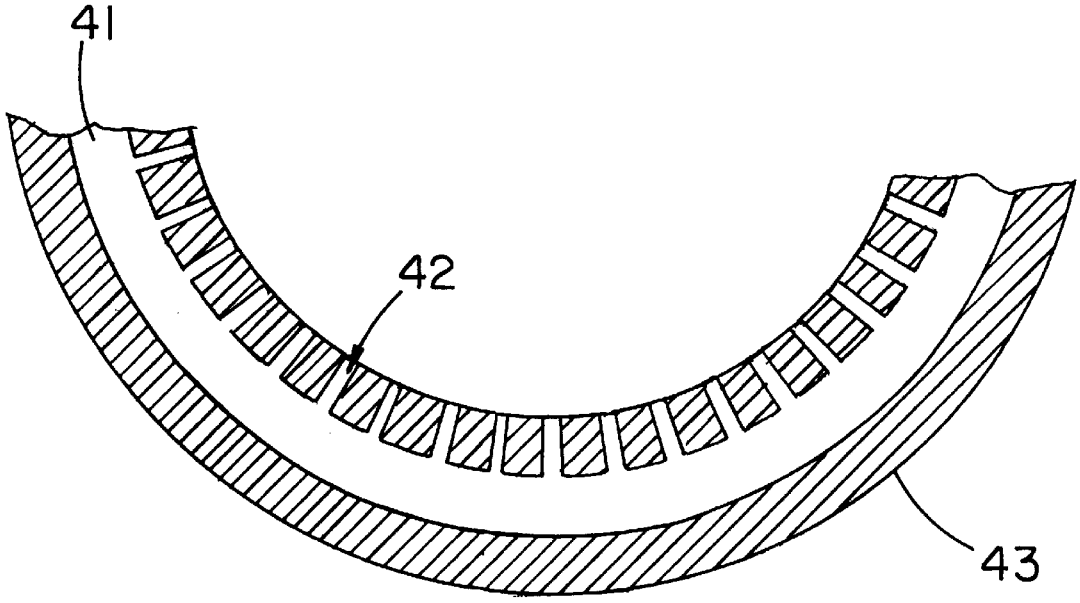
FIG. 12 is a schematic cross sectional view of the present invention taken from line 12—12 of FIG. 11.
Figure 13:
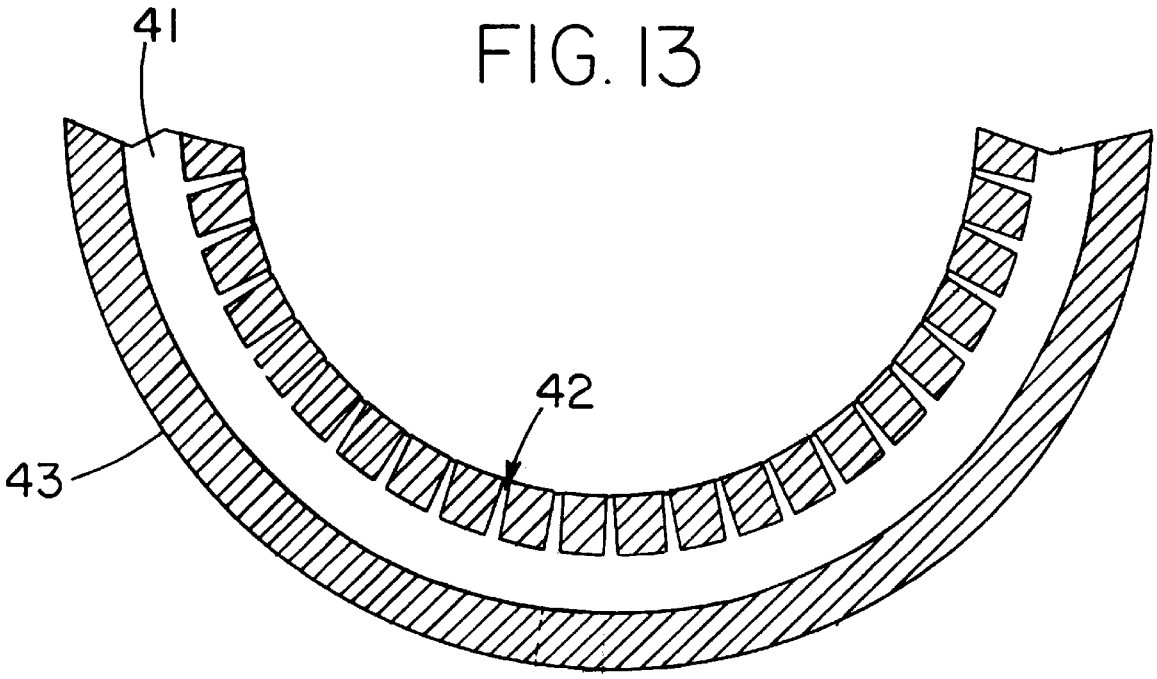
FIG. 13 is a schematic cross sectional view of the present invention.
Figure 14:
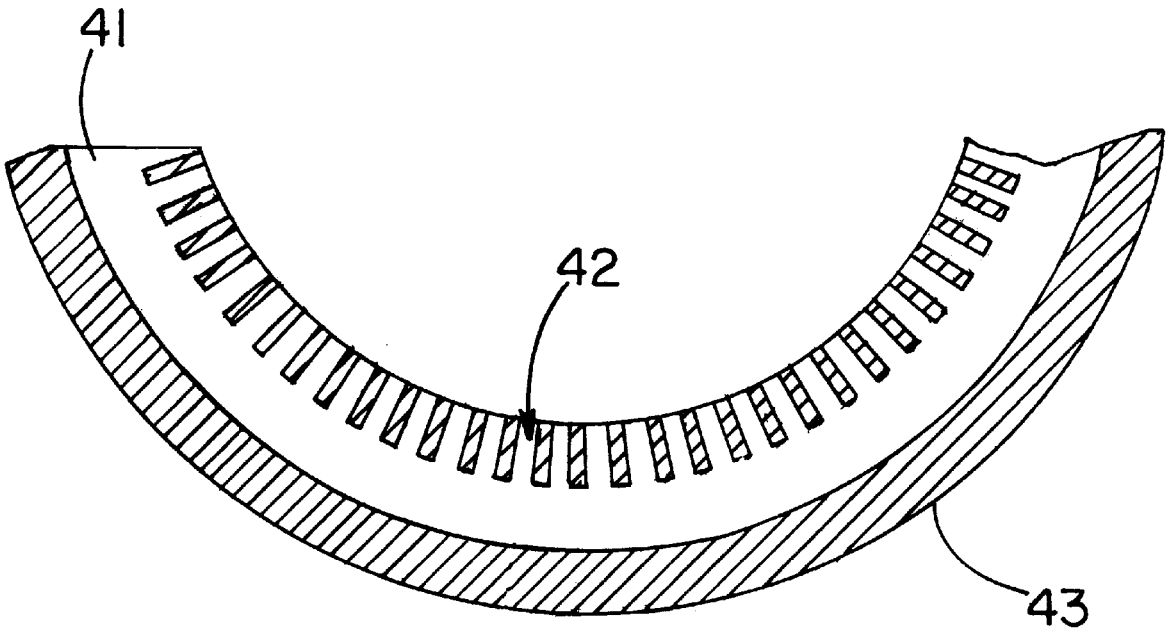
FIG. 14 is a schematic cross sectional view of the present invention.
Figure 15:
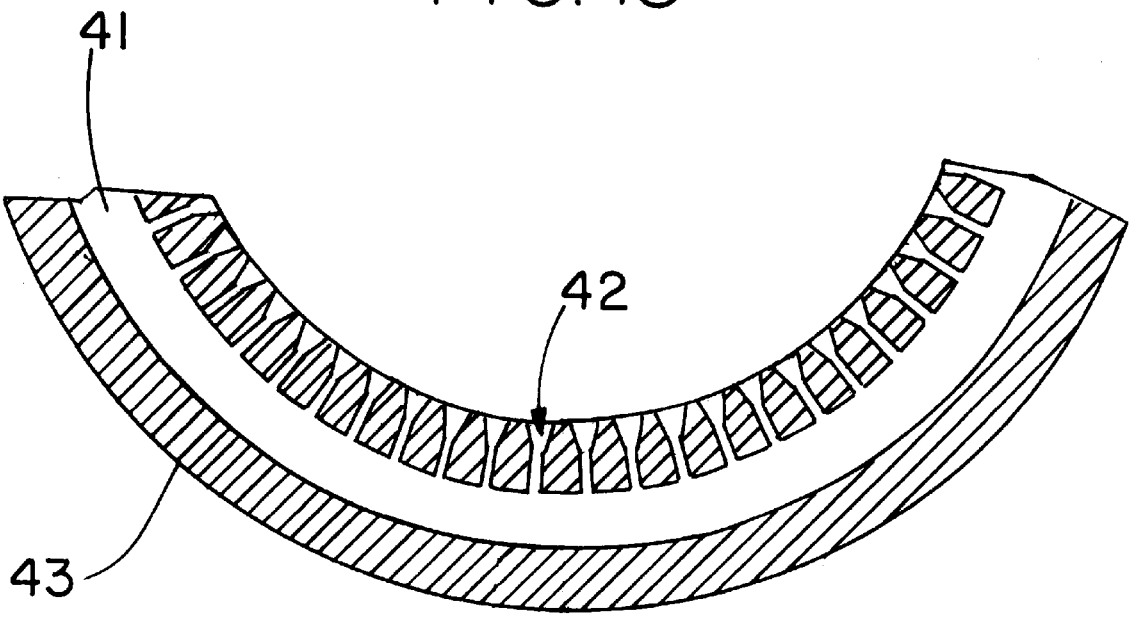
FIG. 15 is a schematic cross sectional view of the present invention.
Figure 17:
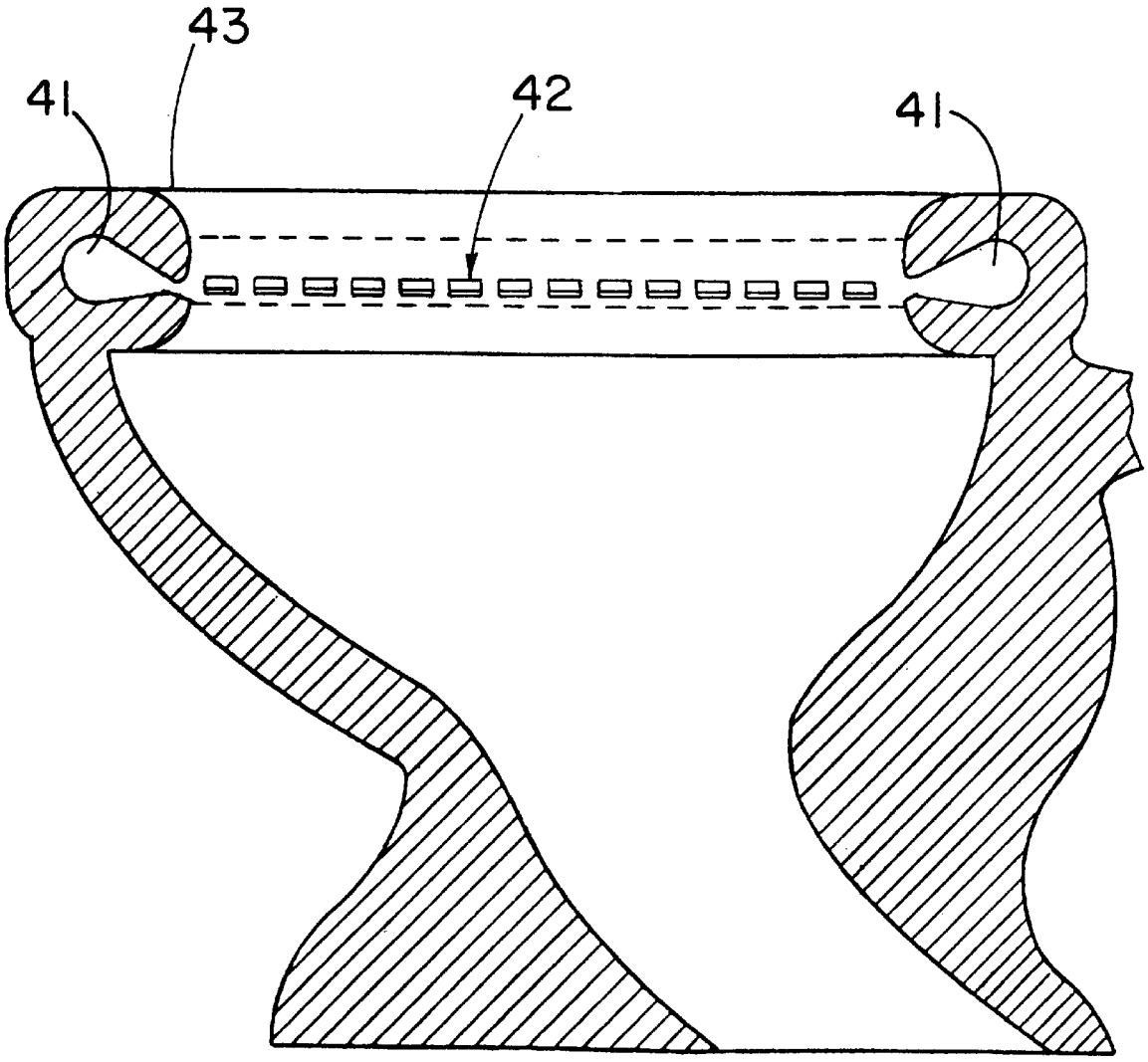
FIG. 17 is a schematic cross sectional view of an alternate embodiment of the present invention.
Figure 18:
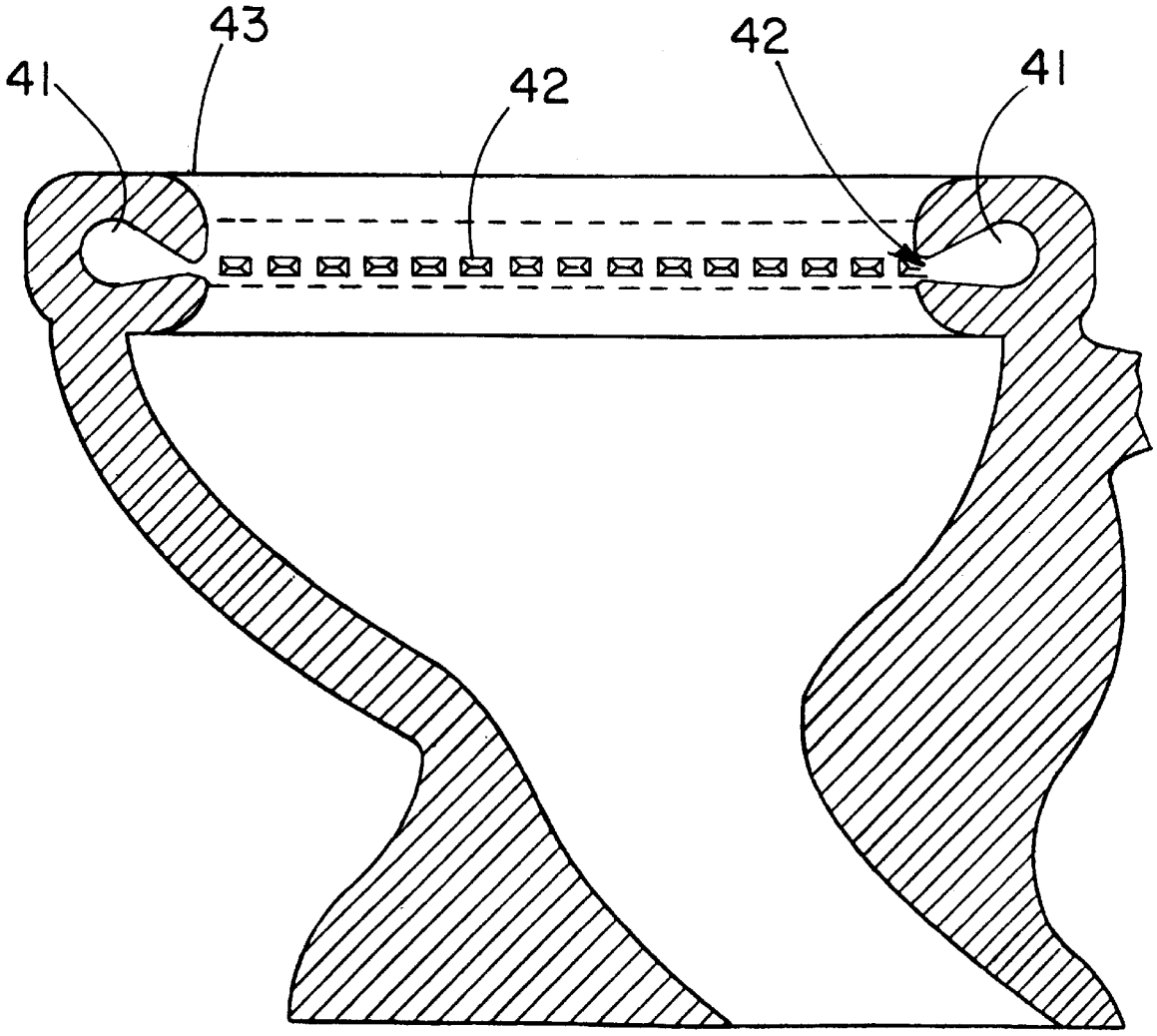
FIG. 18 is a schematic cross sectional view of the alternate embodiment of the present invention.

The vent holes may be round or tubular, as shown in FIG. 11. Alternate vent holes include a rectangular configuration, shown in FIGS. 14 and 17, and conical vent holes, shown in FIGS. 15 and 18. The rectangular vent holes provide more of a blanket of air than the circular version. The jets of air ejected from the conical vent holes travel faster than the air exiting the round vent holes. In any of these embodiments, the bore could extend out and taper together towards the vent holes, as best seen in FIGS. 17 and 18.

Where round vent holes are used, an inner diameter of each of the vent holes is preferably between 1 and 5 mm. Ideally, the vent holes are spaced between 3 and 10 to mm apart from outer edges thereof. This spacing is close enough that a "shield" effect is created, much like a blanket of air.

Figure 16:
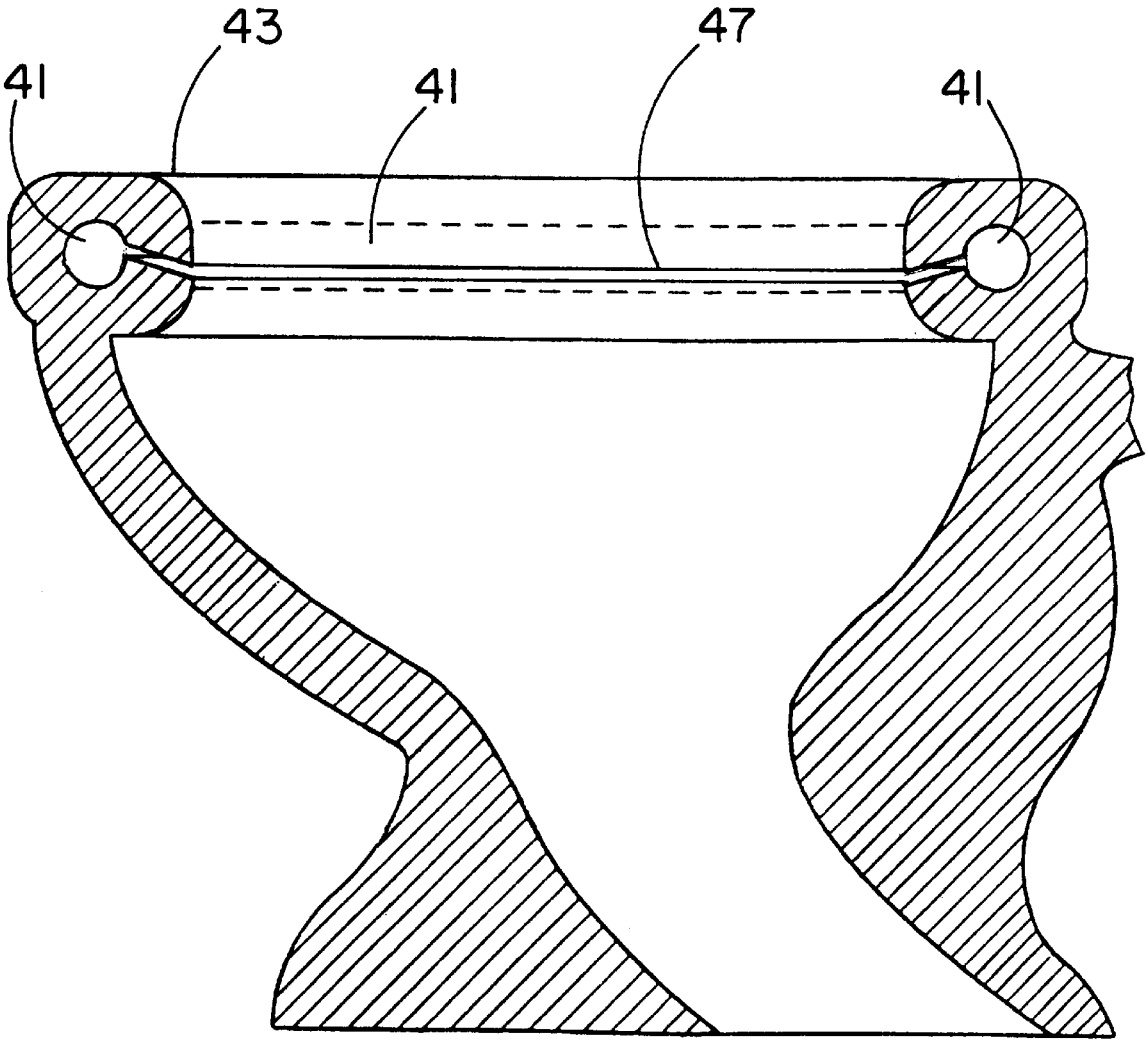
FIG. 16 is a schematic cross sectional view of the present invention.

Alternatively, as illustrated in FIG. 16, the rim could have a vent slot 47 extending outwardly from the bore through an inner perimeter of the rim. Again, the vent slot should angled downwardly at an angle of at least one degree from a horizontal plane, but not over 45 degrees.

An air pump is in communication with the bore of the rim.

The air pump should be capable of producing an output of 10 to 500 psi. Exemplary air pumps include rotary blowers as well as fans with radial blades.

A seat switch 27 may be mounted to an upper surface of the rim of the toilet bowl and be in electrical communication with the air pump. The switch would activate the pump when the toilet seat to is raised. The switch would deactivate the pump when the toilet seat is lowered.

An override switch 28 may disconnect the seat switch from the air pump. This would be useful in a household has children or child guests who would play with the toilet seat merely to activate the device. More importantly, it would allow the user to turn the air pump off when cleaning the toilet bowl.

Alternatively or in any combination with the above switches, a pressure transducer 29 is coupled to an upper surface of a toilet seat and in communication with the air pump. The pressure transducer activates the air pump when a user sits on the toilet seat.

Alternatively or in any combination with the above switches, a temperature transducer 30 is coupled to an upper surface of a toilet seat and in communication with the air pump. The temperature transducer senses the body heat of a user sitting on the toilet seat whereupon it activates the air pump.

Alternatively or in any combination with the above switches, an auxiliary switch 31 may be in communication with the air pump for selectively activating the air pump independent of the seat switch. This would be used when the seat is not raised and would ideally be located near the toilet flushing handle for convenience.

Alternatively or in any combination with the above switches, an abort switch 32 may be used to deactivate the air pump. As shown in FIG. 9, all of the switches would be connected to the abort switch. The abort switch allows a user to completely shut down the system, especially necessary when cleaning the toilet, where any of the number of switches could be accidentally activated.

The modified toilet bowl is used in the same manner as the splash shield set forth above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A splash shield device for mounting to a toilet bowl, the splash shield device comprising:

an annular main portion adapted for mounting below a rim of a toilet bowl, said main portion having upper and lower sides and front and back ends;

said main portion having a bore extending therethrough, said bore being in communication with a source of pressurized air;

said main portion having a vent means in communication with said bore for permitting passage of air from said bore through an inner perimeter of said main portion;

wherein said main portion has at least one opening into said bore, at least one air supply being connected to said opening of said main portion and in fluid communication with said source of pressurized air; and wherein said air supply line extends along said lower side of said main portion.

2. The splash shield device of claim 1, wherein an inner periphery of said main portion is vertically flush with an inner periphery of said rim of said toilet bowl.

3. The splash shield device of claim 1, further comprising a plurality of generally J-shaped support hooks extending from said main portion and adapted for hooking to said rim of said toilet bowl.

4. The splash shield device of claim 1, wherein said vent holes are angled downwardly at an angle of at least one degree from a horizontal plane.

5. The splash shield device of claim 1, wherein said vent means comprises a plurality of vent hole extending into said bore from an inner perimeter of said main portion.

6. The splash shield device of claim 5, wherein said vent holes are rectangular.

7. The splash shield device of claim 5, wherein said vent holes are conical.

8. The splash shield device of claim 1, further comprising an air pump being in communication with said bore of said main portion.

9. The splash shield device of claim 1, wherein said vent means comprises a vent slot extending around said main portion and extending into said bore from an inner perimeter of said main portion.

10. A splash shield device for mounting to a toilet bowl, the splash shield device comprising:

an annular main portion adapted for mounting below a rim of a toilet bowl, said main portion having upper and lower sides and front and back ends;

wherein an inner periphery of said main portion is vertically flush with an inner periphery of said rim of said toilet bowl;

a plurality of generally J-shaped support hooks extending from said main portion and adapted for hooking to said rim of said toilet bowl;

said main portion having a bore extending therethrough, said bore being in communication with a source of pressurized air;

said main portion having a plurality of vent holes extending into said bore from an inner perimeter of said main portion;

said vent holes being angled downwardly at an angle of at least one degree from a horizontal plane;

an air pump being in communication with said bore of said main portion;

said lower side of said main portion having four openings into said bore;

four air supply lines being connected to said openings of said main portion and in fluid communication with said air pump;

said air supply lines extending along said lower side of said main portion;

said air supply lines extending around an inner portion of said back end of said main portion and over said rim of said toilet bowl;

said air supply lines tapering together and opening into a single tube, said tube having an air pressure adjustment valve for adjusting the volume of air travelling to said main portion;

a seat switch being mounted to an upper surface of said rim of said toilet bowl and in communication with said air pump, said switch activating said pump when said toilet seat is raised, said switch deactivating said pump when said toilet seat is lowered;

an override switch for disconnecting said seat switch from said air pump;

a pressure transducer adapted for coupling to a toilet seat and in communication with said air pump, said pressure transducer activating said air pump when a user sits on said toilet seat;

a temperature transducer adapted for coupling to an upper surface of a toilet seat and in communication with said air pump, said temperature transducer sensing body heat of a user sitting on said toilet seat whereupon it activates said air pump;

an auxiliary switch in communication with said air pump for selectively activating said air pump independent of said seat switch; and an abort switch for deactivating said air pump.

* * * * *